US006086024A

United States Patent [19]

Congress

[11] Patent Number: 6,086,024

[45] Date of Patent: Jul. 11, 2000

[54] ERGONOMIC ARM SUPPORT APPARATUS

[75] Inventor: Michael Alan Congress, 1827 Woodland Ave., Palo Alto, Calif. 94303

[73] Assignee: Michael Alan Congress, Palo Alto, Calif.

[21] Appl. No.: 09/129,975

[22] Filed: Aug. 5, 1998

[51] Int. Cl.[7] ..... B68G 5/00

[52] U.S. Cl. ..... 248/118; 248/298.1; 248/918; 248/118.1

[58] Field of Search ..... 248/118, 286.1, 248/298.1, 918, 118.1, 110.3, 110.5

[56] References Cited

U.S. PATENT DOCUMENTS

| | | | |
|---|---|---|---|
| 127,208 | 5/1872 | Alexander | 248/118 |
| 351,079 | 10/1886 | Teague | 248/118 |
| 360,529 | 4/1887 | Jurey | 248/118 |
| 389,053 | 9/1888 | Brown | 248/118 |
| 655,885 | 8/1900 | Neal | 248/118 |
| 2,358,551 | 9/1944 | Beaton | 248/118 |
| 4,069,995 | 1/1978 | Miller | 248/118.1 |
| 4,996,977 | 3/1991 | Tiedeken | 128/77 |
| 4,997,054 | 3/1991 | Denny et al. | 180/331 |
| 5,058,840 | 10/1991 | Moss et al. | 248/118.5 |
| 5,149,033 | 9/1992 | Burzler | 248/176 |
| 5,158,256 | 10/1992 | Gross | 248/118.3 |
| 5,161,760 | 11/1992 | Terbrack | 248/118 |
| 5,335,888 | 8/1994 | Thomsen | 248/118.5 |
| 5,369,805 | 12/1994 | Bergsten et al. | 297/411.35 |
| 5,560,573 | 10/1996 | Colver et al. | 248/118 |
| 5,597,207 | 1/1997 | Bergsten et al. | 297/411.35 |
| 5,605,311 | 2/1997 | McGrath et al. | 248/118 |
| 5,683,064 | 11/1997 | Copeland et al. | 248/278.1 |
| 5,746,480 | 5/1998 | Bonutti | 297/411.35 |
| 5,810,301 | 9/1998 | McGrath et al. | 248/118 |
| 5,915,655 | 6/1999 | Gutowski | 248/118.5 |

*Primary Examiner*—Ramon O. Ramirez
*Assistant Examiner*—Walter Landry
*Attorney, Agent, or Firm*—Blakely, Sokoloff, Taylor & Zafman LLP

[57] ABSTRACT

An ergonomic workstation for supporting the arms of a computer operator. Arm cradles are suspended from telescoping booms which are pivotally attached to a computer monitor stand.

41 Claims, 6 Drawing Sheets

ERGONOMIC ARM SUPPORT APPARATUS

BACKGROUND OF THE INVENTION

1. Field of the Invention

This invention relates generally to ergonomic devices, and more specifically to those used with computer workstations.

2. Background Information

Computer operators in the home and in the workplace are increasingly suffering from sore or strained muscles in the hands, wrists, arms, shoulders, and neck. Other computer operators are simply suffering from fatigue of those muscles. At a minimum, these ailments result in decreased productivity. As computers are becoming more prevalent both in the home and especially the workplace, this problem is becoming increasingly commonplace. The problem is worsened when the computer is used for extended periods of time and computer operators must continue to work regardless of any muscle ailments. Continued prolong use under these conditions can lead to repetitive stress syndrome and eventually to carpal tunnel syndrome which are leading causes of injury in the workplace.

There is a need to prevent this muscle aggravation. Not only is it desired to prevent this problem for the comfort of computer operators but also to prevent serious injury such as muscle strain or carpal tunnel syndrome. A serious injury such as carpal tunnel syndrome can prevent a person from operating a keyboard for weeks and possibly months.

SUMMARY OF THE INVENTION

The present invention is directed at providing ergonomic arm support to computer keyboard operators. In accordance with one embodiment of the present invention, two telescoping booms are pivotally attached to a computer monitor stand. Arm cradles containing either elbow or wrist supports, or both, are then suspended from the free end of the boom. The user, seated at a computer workstation, then places an arm in each arm cradle. An advantage of the present invention is that it provides arm support from a point above the computer keyboard. This configuration allows for a greater range of movement, while continuing to support each arm though the entire range of movement. Additionally, this configuration requires little or no desk space to be taken up. Additional features and benefits of the present invention will become apparent from the detailed description, figures, and claims set forth below.

BRIEF DESCRIPTION OF THE DRAWINGS

Various embodiments of the present invention will be described in detail with reference to the following drawings in which like reference numerals refer to like elements. The present invention is illustrated by way of example and not limitation in the accompanying figures.

DETAILED DESCRIPTION

An ergonomic arm support apparatus is disclosed. In the following description, specific details are set forth, such as material types, dimensions, etc., in order to provide a thorough understanding of the present invention. However, it will be obvious to one of ordinary skill in the art that the invention may be practiced without these specific details. In other instances, well-known structures, elements, materials, etc. have not been described in particular detail in order to avoid unnecessarily obscuring the present invention. The discussion will mainly be limited to using the present invention in conjunction with a computer workstation. It will be recognized, however, that such focus is for descriptive purposes only and the apparatus of the present invention is applicable to a wide variety of applications in which arm support is necessary and/or useful.

The present invention provides ergonomic arm support to users of a computer workstation. Such support is necessary to alleviate muscle stain caused by the repetitive activity of operating a keyboard. Frequently, operating a computer keyboard for an extended period of time can lead to strain on the various muscles of the hands, wrists, arms, shoulders, and neck. Continued strain over a period of time can lead to carpal tunnel syndrome. Carpal tunnel syndrome can often prevent a person from performing his or her job. The object of the present invention is to prevent the muscle fatigue, soreness, or strain in the hands, wrists, arms, shoulders, and neck caused by extended keyboard operation. In turn, ailments such as carpal tunnel syndrome are prevented. An advantage of the present invention is that is allows the user a wide range of mobility while providing continuous arm support. A user can simply move his or her arms around the area proximate the keyboard to, for example, operate a pointing device, and the arm support apparatus moves with the arms, supporting the elbows and wrists during the entire range of movement. The present invention may be implemented in many applications where people perform repetitive tasks with their arms or where arm support is necessary. For example, the present innovation may be used to aid the control panel operator of industrial equipment. In another application, the present invention can be used to support and steady the arms of a person who is dealing with small objects, such as a model marker or a watch repair technician.

In accordance with one embodiment of the present invention, two telescoping booms are pivotally attached to a computer monitor stand. Arm cradles containing a forearm support is suspended from the free end of the boom. The user, seated at a computer workstation, then places a forearm in each arm cradle so that each forearm, from the elbow through the wrist, is supported. The user can then operate the keyboard while the arms are continually supported during the arm movement associated with operating a keyboard.

Figure 1:
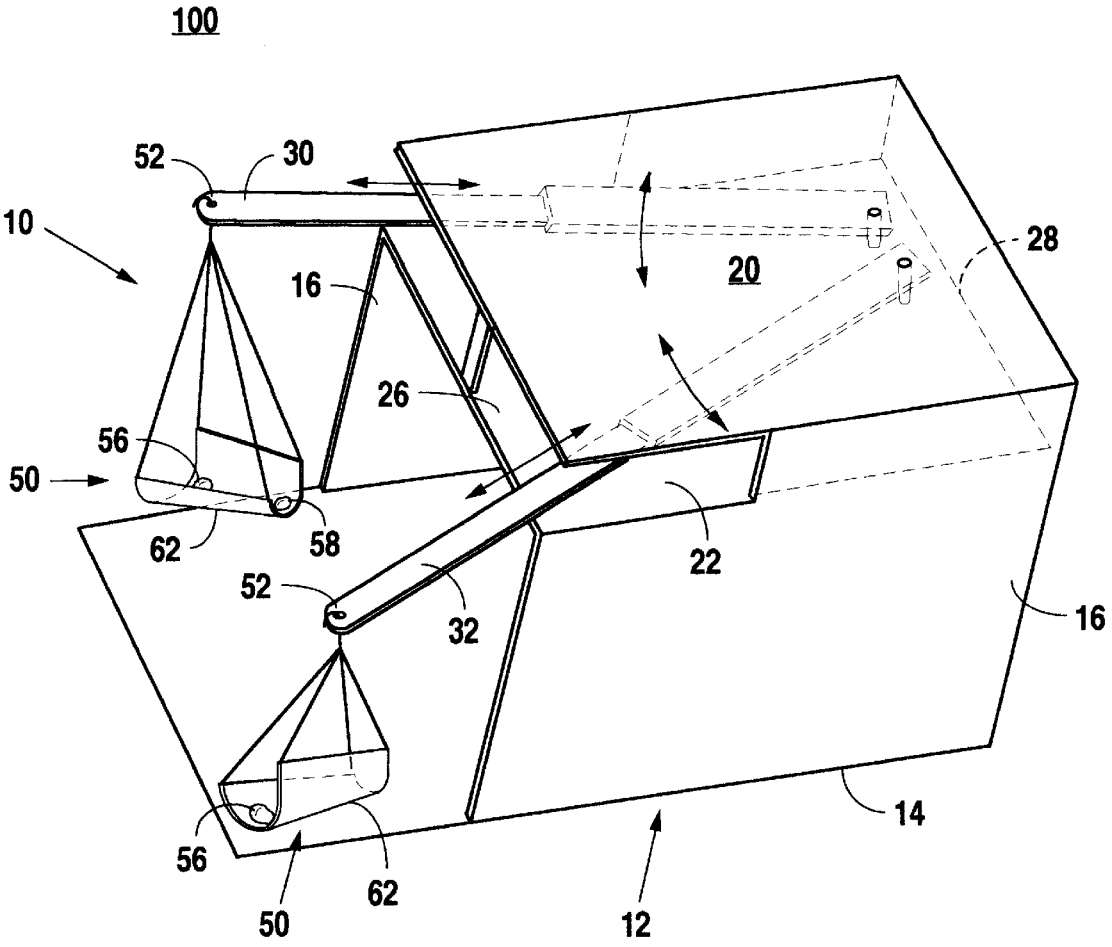
FIG. 1 illustrates an arm support apparatus in accordance with the teachings of the present invention.
Figure 2:
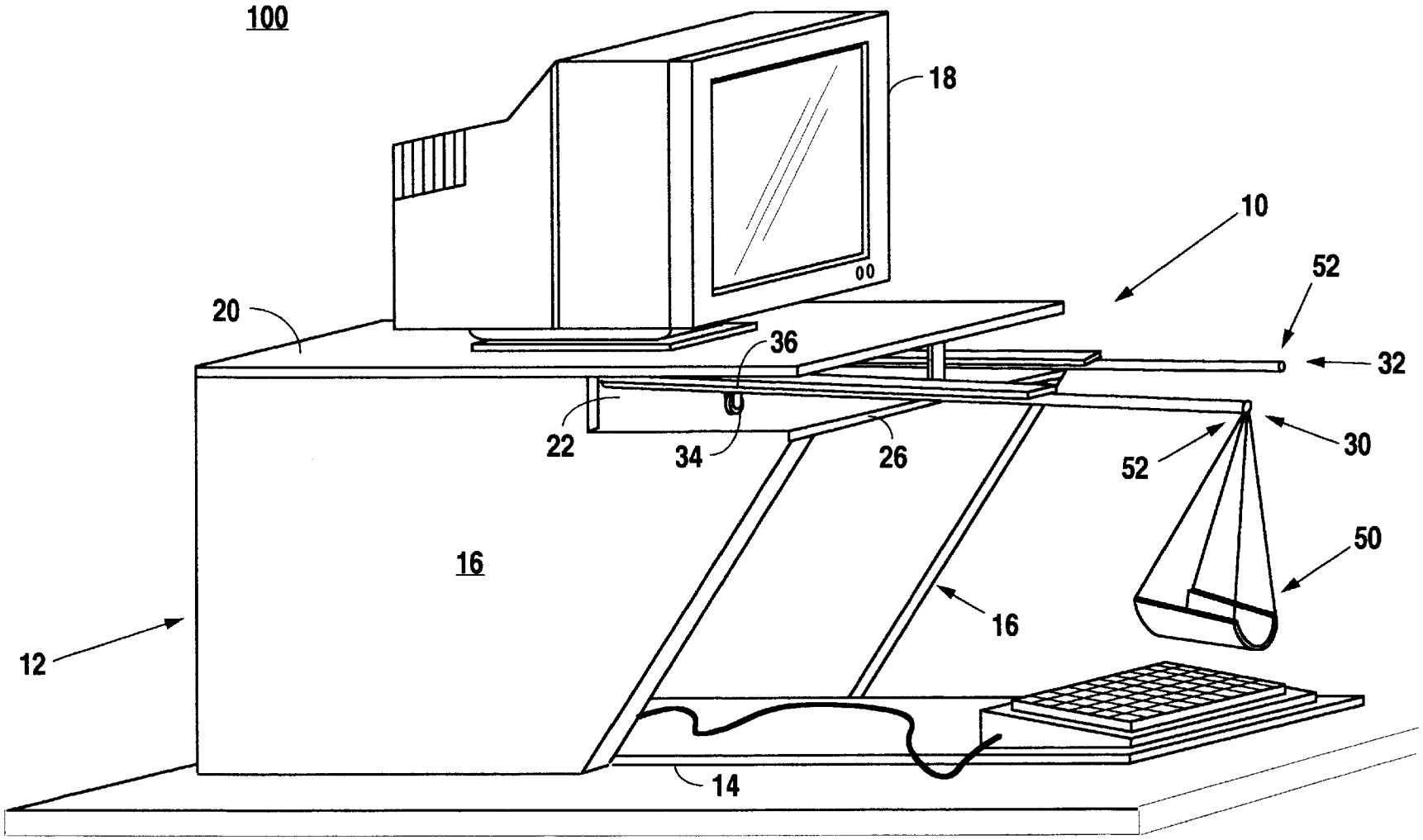
FIG. 2 illustrates an arm support apparatus in accordance with the teachings of the present invention

An ergonomic workstation (100) is illustrated in FIGS. 1 and 2. The work station comprises an arm support apparatus (10) attached to a computer monitor stand (12). The monitor stand (12) comprises a stand base (14) and two sides (16) attached thereto. The computer monitor (18) rests on the monitor platform (20) which is attached to the two sides (16). Also attached the two sides (16) is a shelf (22) which is positioned slightly below the monitor platform (20). The shelf has a front portion (26) and a rear portion (28). Booms (30) and (32) are pivotally attached to the rear portion (28) of the shelf. The booms (30) and (32) each may have a roller (34) located at a section (36) of the booms. The rollers (34) allow the booms (30) and (32) to move side to side in a smooth fashion. Arm cradles (50) are suspended from the forward ends (52) of each of the booms (30) and (32). The arm cradles (50), illustrated in FIG. 1, each comprise an elbow support (56) and a wrist support (58). The support provided by the arm cradles (50) can vary in alternative embodiments wherein the entire forearm from the elbow to the wrist is supported. In another alternative embodiment, just forearm support can be solely a wrist support or solely an elbow support. Through out this detailed description, the term forearm support should be understood as including any one or any combination of the aforementioned supports. For example, the arm cradle (50) illustrated in FIG. 2 is a U-shaped arm cradle which comprises a single forearm support. The U-shaped arm cradle (50) can be long enough to support the entire forearm from the elbow to the wrist or the cradle (50) can be relatively short to solely support an elbow or a wrist of the user.

Figure 7:
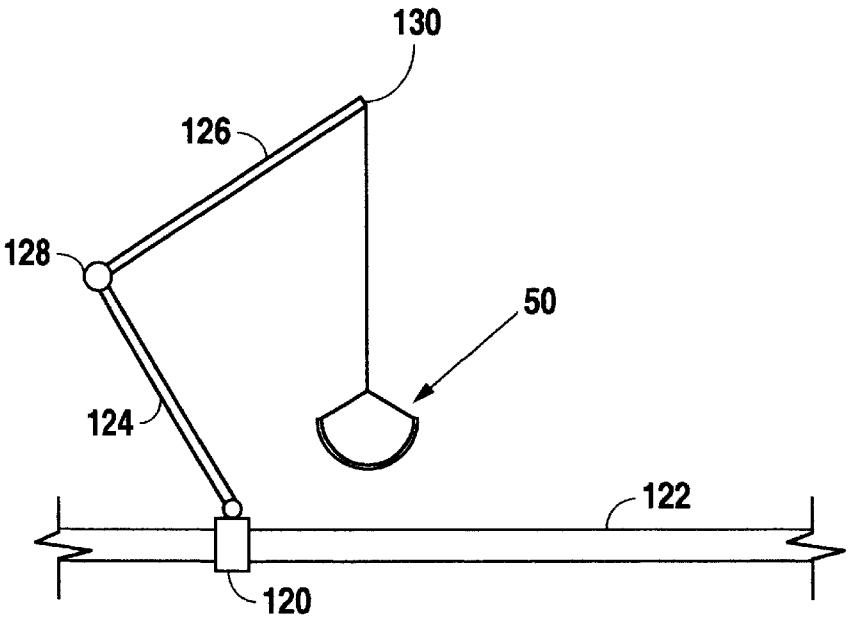
FIG. 7 illustrates an alternative embodiment in accordance with the teachings of the present invention.

In alternative embodiments, a computer monitor stand can be replaced by a shelf on a wall. In such an embodiment, the computer monitor rests on the shelf's top-side surface and the booms are pivotally attached to the bottom-side surface of the shelf. In another alternative embodiment, the booms can be pivotally mounted to a second shelf. In still another embodiment, the arm cradles (50) can each be suspended from a structure attached to a desk as illustrated in FIG. 7. Referring to FIG. 7, a clamp (120) is secured to a desk (122). A rod (124) is pivotally attached to the clamp (120). A boom (126) is attached to the rod (124) by a hinge (128). The arm cradle (50) suspends from the free end (130) of boom (126).

Figure 3:
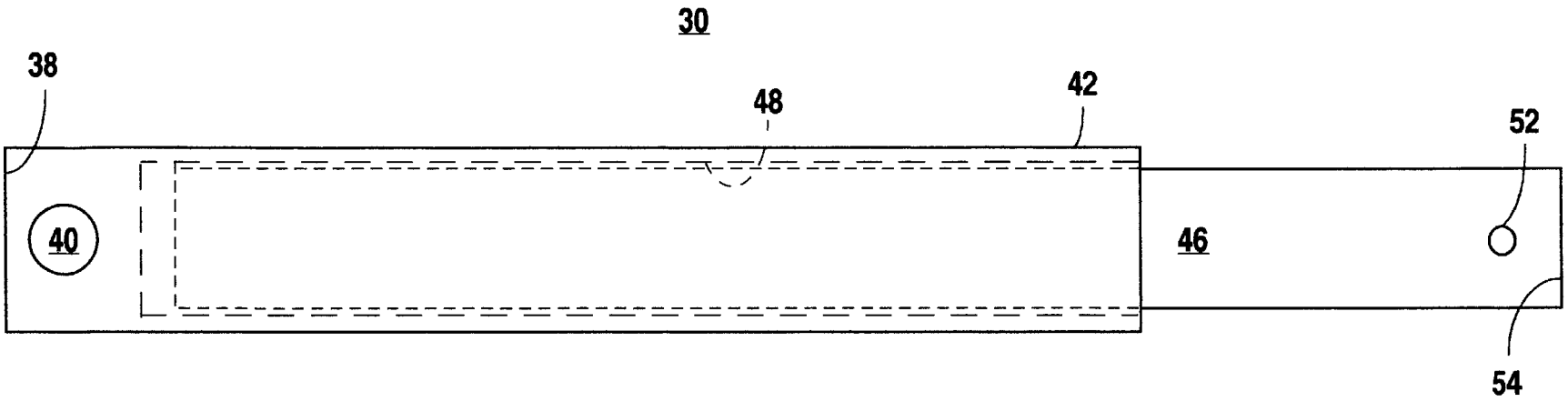
FIG. 3 illustrates a telescoping boom in accordance with the teachings of the present invention.

FIG. 3 illustrates one embodiment of the boom (30) or (32). In the illustrated embodiment, the boom (30) is telescoping to allow motion from the front to the back of the keyboard and vice-versa. The boom (30) is made up of an outer member (42) and an inner member (46). The inner member (46) smoothly slides along a track (48) within the outer member (42). The outer member (42) has a rear end (38) which contains a pivot aperture (40). A pin or a bolt can be used to pivotally attached the outer member (42) through the pivot aperture (40) to a computer monitor stand. The boom (30) should smoothly and freely pivot thus allowing the user to move his or her hands around the keyboard and effectively operate a pointing device. The inner member (46) contains an aperture (52) at its forward end (54) for attaching and suspending an arm cradle (50).

One embodiment of the arm cradle (50) is illustrated in FIG. 1. The arm cradle comprises an elbow support (56) and a wrist support (58). The elbow support (56) and the wrist support (58) each have two suspension cables (60) attach thereto. A separating member (62) is attached between the elbow support (56) and the wrist support (58). The separating member (62) keeps the wrist support (58) and the elbow support (56) positioned so that the user does not need to reposition the supports with each use. In alternative embodiments, the separating member (62) is adjustable so that users with different arm sizes can be accommodated. The wrist support (58) and the elbow support (56) may contain padding for the comfort of the user. In an alternative embodiment, the wrist support (58) and elbow support (56) can be made all one piece to comprise a forearm support as illustrated in FIGS. 4A and 4B.

Figure 4B:
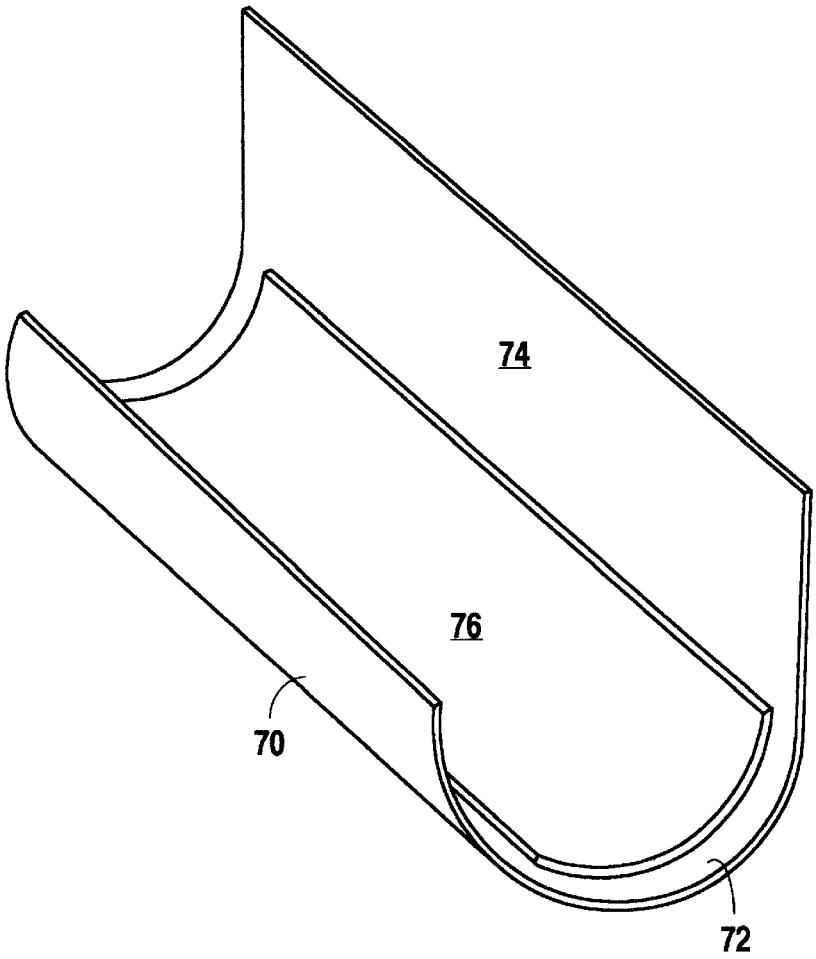
FIG. 4B illustrates a rotated view of a J-shaped arm cradle in accordance with the teachings of the present invention.
Figure 4A:
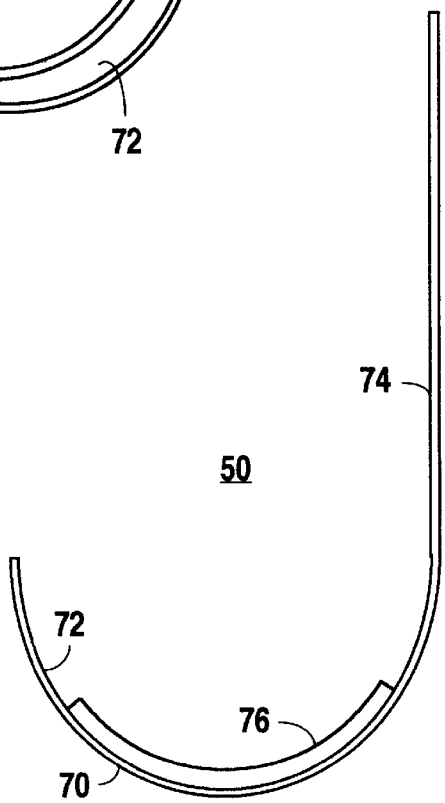
FIG. 4A illustrates a J-shaped arm cradle in accordance with the teachings of the present invention.
Figure 6:
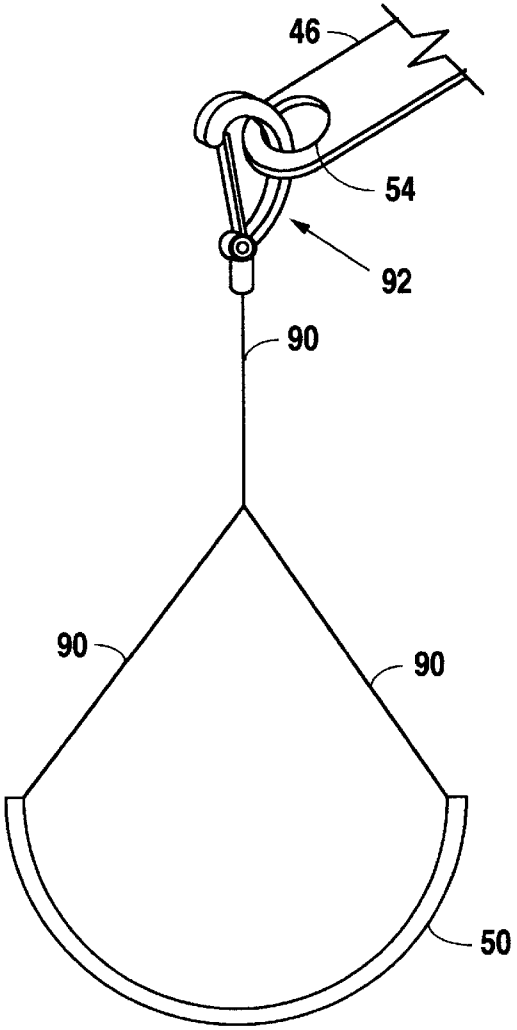
FIG. 6 illustrates the use of a spring clip and suspension cables in accordance with the teachings of the present invention.
Figure 8:
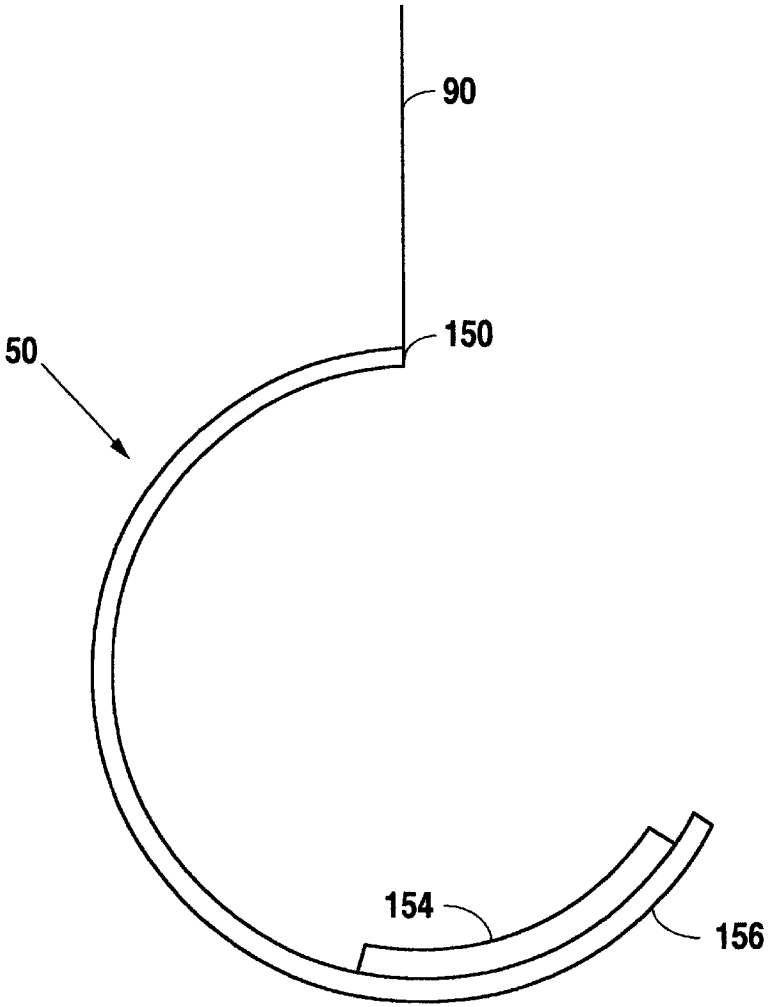
FIG. 8 illustrates a C-shaped arm cradle in accordance with the teachings of the present invention.

Referring to FIGS. 4A and 4B, the arm cradle (50) should be made of a durable, lightweight material such as plastic. The arm cradle (50) in the embodiment illustrated in FIGS. 4A and 4B is J-shaped. However, in an alternative embodiment, the arm cradle (50) can be U-shaped as illustrated in FIGS. 2 and 6. In the J-shaped embodiment, the arm cradle (50) comprises a curved portion (70) having and an inner surface (72) and a straight portion (74). The curved portion (70) provides the arm support, while the arm cradle (50) is suspended from the straight portion (74). The inner surface (72) can be equipped with a forearm pad (76). In one embodiment, the straight portion (74) of the J-shaped arm cradle can be long enough to be directly coupled to the end of the boom. In still another alternative embodiment of the arm cradle, the arm cradle (50) is C-shaped as illustrated in FIG. 8. The C-shaped arm cradle (50) is suspended from the boom (not shown) by a suspension cable (90) which is attached to the top-portion (150) of the C-shaped arm cradle (50). The C-shaped arm cradle has an counterbalanced bottom (156) so that when the user places a forearm on the pad (154), the weight of the forearm causes the portion of the arm cradle (50) having pad (154) to be positioned beneath the point where the top-portion (150) attaches to suspension cable (90).

Figure 5:
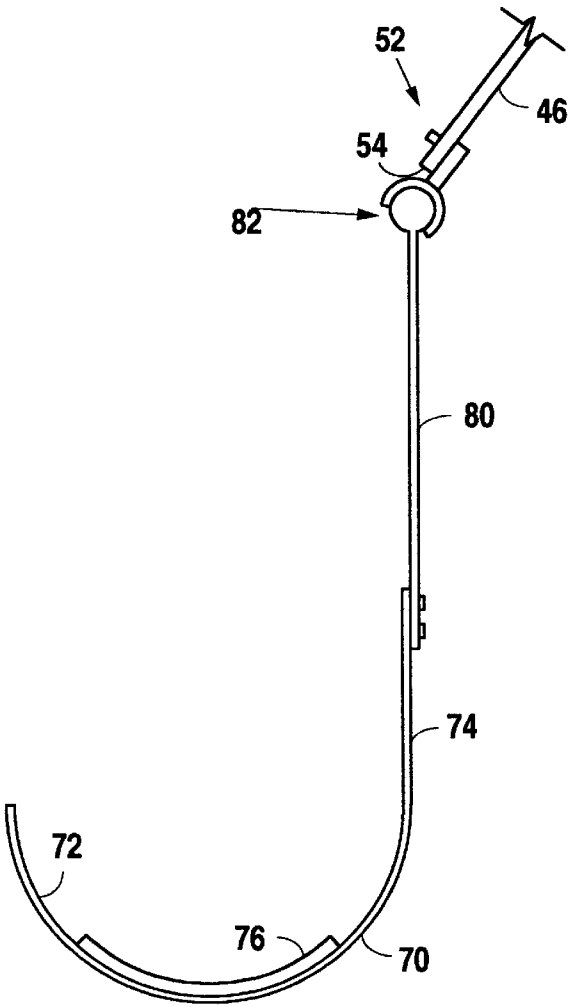
FIG. 5 illustrates the use of a ball-and-socket joint in accordance with the teachings of the present invention.

There are a variety of ways in which the arm cradle can be suspended from the boom. In one embodiment the arm cradles can be directly connected to each of the second ends (52) of the booms. In alternative embodiments, suspension assemblies connect the arm cradles (50) to the second end (52) of each of the booms (30) and (32). The suspension assembly contains either wires, cables, or coupling rods, each having a proximal end and a distal end. The proximal end is attached to the arm cradle (50). The distal end is attached to either a spring clip, a hook, or a ball-and socket joint. The wires, cables, or coupling rods can be used in any combination with spring clips, hooks, or ball-and socket joints for attachment to the second end (52) of each of the booms (30) and (32). For example, coupling rods (80) used in conjunction with ball-and-socket joints (82) to suspend the arm cradle (50) is illustrated in FIG. 5. Alternatively, FIG. 1 illustrates the arm cradles being suspended by stiff wires which are directly attached to the booms. FIG. 6 illustrates a U-shaped arm cradle being suspended from the boom by cables (90) and spring clips (92).

The details, such as dimensions and materials, set forth within the specification are exemplary of the disclosed embodiments only. While numerous alterations and modifications to the present invention will no doubt become apparent to a person ordinarily skilled in the art having read the foregoing description, it is to be understood that the particular embodiments shown and described by way of illustration are in no way intended to be limiting. Therefore, reference to the details of the illustrated diagrams is not intended to limit the scope of the claims which themselves recite only those features regarded as essential to the invention.

What is claimed is:

1. An arm support apparatus comprising: a base; first and second telescoping booms each having a first end and a second end, said first ends rotatably attached to said base; and an arm support cradle hung from each of said second ends.

2. The apparatus of claim 1 wherein said booms have a roller attached at or near a middle of said booms.

3. The apparatus of claim 1 wherein said cradle comprises:

a first support having at least one cable coupled to said second end of said boom; and a second support having at least one cable coupled to said second end of said boom.

4. The apparatus of claim 3 wherein said first support is a wrist support and said second support is an elbow support.

5. The apparatus of claim 3 where said first support is a wrist support and said second support is a forearm support.

6. The apparatus of claim 1 wherein said cradle comprises:

a body having a first portion and a second portion, said first portion comprising an elbow support, said second portion comprising a wrist support.

7. The apparatus of claim 6 wherein said body has a U-shape.

8. The apparatus of claim 6 wherein said body has a J-shape.

9. The apparatus of claim 1 wherein said base comprises a computer monitor stand.

10. The apparatus of claim 9 wherein said computer monitor stand comprises:

a monitor platform; and a shelf located below said monitor platform, said boom pivotally attached to said shelf.

11. The apparatus of claim 1 further comprising a spring clip coupled to a cable for suspending said cradle from said second ends of said booms.

12. The apparatus of claim 1 further comprising a ball-and-socket joint coupled to a coupling rod for suspending said cradle from said second end of said booms.

13. An arm support apparatus comprising: a first telescoping boom and a second telescoping boom, each being rotatably attached to a base and having an end; and an arm support cradle hung from each of said ends of said booms.

14. The apparatus of claim 13 wherein said booms have a roller attached at or near a middle of said booms.

15. The apparatus of claim 13 wherein said cradle comprises:

a first support having at least one cable coupled to said end of said boom; and a second support having at least one cable coupled to said end of said boom.

16. The apparatus of claim 15 wherein said first support is a wrist support and said second support is a elbow support.

17. The apparatus of claim 13 wherein said cradle comprises:

a body having a first portion and a second portion, said first portion comprising an elbow support, said second portion comprising a wrist support.

18. The apparatus of claim 17 further comprising a first pad located on said elbow support and a second pad located on said wrist support.

19. The apparatus of claim 17 wherein said body has a U-shape.

20. The apparatus of claim 17 wherein said body has a J-shape.

21. The apparatus of claim 13 wherein said first and second booms are telescoping.

22. The apparatus of claim 13 further comprising a spring clip coupled to a cable for suspending each of said cradles from said second ends of said booms.

23. The apparatus of claim 6 wherein said body has a C-shape.

24. The apparatus of claim 17 wherein said body has a C-shape.

25. An arm support apparatus comprising: a base; first and second telescoping booms each having a first end and a second end, said first ends rotatably attached to said base; a first arm support cradle and a second arm support cradle; and a first suspension assembly hanging said first cradle from said second end of said first telescoping boom and a second suspension assembly hanging said second cradle from said second end of said second telescoping boom.

26. The apparatus of claim 25 wherein each of said booms have a roller attached at or near a middle of said booms.

27. The apparatus of claim 25 wherein said cradle comprises:

a first support having at least one cable coupled to said second end of said boom; and a second support having at least one cable coupled to said second end of said boom.

28. The apparatus of claim 27 wherein said first support is a wrist support and said second support is a elbow support.

29. The apparatus of claim 27 where said first support is a wrist support and said second support is a forearm support.

30. The apparatus of claim 25 wherein said cradle comprises:

a body having a first portion and a second portion, said first portion comprising an elbow support, said second portion comprising a wrist support.

31. The apparatus of claim 30 further comprising a first pad located on said elbow support and a second pad located on said wrist support.

32. The apparatus of claim 30 wherein said body has a U-shape.

33. The apparatus of claim 30 wherein said body has a J-shape.

34. The apparatus of claim 25 wherein said base comprises a computer monitor stand.

35. The apparatus of claim 34 wherein said computer monitor stand comprises:

a monitor platform; and a shelf located below said monitor platform, said boom pivotally attached to said shelf.

36. The apparatus of claim 25 wherein said boom is telescoping.

37. The apparatus of claim 30 wherein said body has a C-shape.

38. The apparatus of claim 25 wherein said each of said first and said second suspension assemblies comprise:

a coupling rod having a proximal end and a distal end, said proximal end attached to said cradle; and a ball-and-socket joint attached to said distal end of said coupling rod.

39. The apparatus of claim 25 wherein said each of said first and said second suspension assemblies comprise:

a cable have a proximal end and a distal end, said proximal end attached to said cradle;

a spring clip attached to said distal end of said coupling rod.

40. The apparatus of claim 25 wherein said each of said first and said second suspension assemblies comprise:

a cable have a proximal end and a distal end, said proximal end attached to said cradle;

a hook attached to said distal end of said coupling rod.

41. The apparatus of claim 25 wherein said each of said first and said second suspension assemblies comprise at least one stiff wire having a proximal end and a distal end, said proximal end attached to said cradle, said distal end attached to each of said second ends of said booms.

* * * * *